US008172351B2

(12) United States Patent
Kaieda et al.

(10) Patent No.: US 8,172,351 B2
(45) Date of Patent: May 8, 2012

(54) PRINTING APPARATUS AND PRINTING METHOD

(75) Inventors: Teruaki Kaieda, Matsumoto (JP); Ryoichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 322 days.

(21) Appl. No.: 12/565,663

(22) Filed: Sep. 23, 2009

(65) Prior Publication Data

US 2010/0073412 A1 Mar. 25, 2010

(30) Foreign Application Priority Data

Sep. 24, 2008 (JP) ..... 2008-243826

(51) Int. Cl.
*B41J 29/38* (2006.01)

(52) U.S. Cl. ..... 347/9

(58) Field of Classification Search ..... 347/5, 9, 347/101, 104

See application file for complete search history.

(56) References Cited

U.S. PATENT DOCUMENTS 6,834,948 B2 * 12/2004 Asano et al. ..... 347/102

FOREIGN PATENT DOCUMENTS

JP 2006-212997 A 8/2006

* cited by examiner

*Primary Examiner* — An Do

(74) *Attorney, Agent, or Firm* — Kilpatrick Townsend & Stockton LLP

(57) ABSTRACT

A printing apparatus includes a transport unit that transports a print medium in a predetermined transport direction, and a printing control unit that performs preliminary printing by ejecting ink droplets through a plurality of nozzles, which are the same as nozzles used for printing a reference mark, onto an area on a downstream side of a specific position in the transport direction in an area of the print medium before printing the reference mark on the specific position of the print medium by ejecting ink droplets through a print head provided with the nozzles for ejecting the ink droplets.

16 Claims, 5 Drawing Sheets

PRINTING APPARATUS AND PRINTING METHOD

This application claims priority to Japanese Patent Application No. 2008-243826, filed Sep. 24, 2009, the entirety of which is incorporated by reference herein.

BACKGROUND

1. Technical Field

The present invention relates to a printing apparatus and a printing method.

2. Related Art

According to the related art, when predetermined printing is performed with respect to a print medium, reference marks indicating a cutting position called a dragonfly are printed in the vicinity of a target image, that is, four corners of the print medium. When printing is performed with respect to plural sheets of a print medium through a printing scheme using a plate such as offset printing, the same reference marks are printed onto all the sheets.

Further, there is known an existing printing method of printing a mark (black color) and a background color (red or white color), which is different from the mark color, in the vicinity of a predetermined surface of media to be cut or media to be printed, in order to increase contrast between the mark and the periphery of the mark (see JP-A-2006-212997).

However, plural sheets of a print medium are cut on the basis of reference marks printed on the uppermost sheet of the print medium in a state in which the plural sheets are collected and overlap each other.

As disclosed in JP-A-2006-212997, the reference marks may be printed together with a target image through an ink jet scheme using nozzles for ejecting ink droplets. However, if the ink droplets are not ejected in the vicinity of the opening of the nozzle for a predetermined period of time, moisture or solvent in the ink is evaporated through contact between the air and the ink in the nozzle, so that the viscosity of the ink may be increased. The increase of the viscosity of the ink may cause various ejection failures such as ejection of the ink droplets from the nozzle at abnormal timing or speed, a curve in the flight of the ink droplets, and non-ejection of the ink droplets. As described above, since the reference mark indicates the cutting position of the print medium, the cutting position is required to be indicated with high accuracy. However, if the reference mark is printed using the nozzle which may cause the ejection failures as described above, the reference mark may not be exactly printed at the position at which the reference mark must be printed.

SUMMARY

An advantage of some aspects of the invention is to provide a printing apparatus and a printing method, which can print a reference mark on a print medium with high accuracy and reduce the amount of ink used.

According to an aspect of the invention, there is provided a printing apparatus including a transport unit that transports a print medium in a predetermined transport direction, and a printing control unit that performs preliminary printing by ejecting ink droplets through a plurality of nozzles, which are the same as nozzles used for printing a reference mark, onto an area on a downstream side of a specific position in the transport direction in an area of the print medium before printing the reference mark on the specific position of the print medium by ejecting ink droplets through a print head provided with the nozzles for ejecting the ink droplets.

According to the invention, the preliminary printing is performed before the reference mark is printed on the print medium. After the preliminary printing is performed, the reference mark is printed through the nozzles which are the same as nozzles used for the preliminary printing. That is, ejection failure of the nozzles is solved during the preliminary printing and then the reference mark is printed, so that the reference mark is exactly printed.

In the case of performing printing with respect to each print medium constituting a set of plural sheets of print medium by driving the print head based on predetermined print data, the printing control unit may perform printing of the reference mark and the preliminary printing onto only an uppermost print medium of the set. According to the configuration, the printing of the reference mark and the preliminary printing are preformed with respect to only the uppermost print medium of the set, so that the amount of ink consumed can be significantly reduced. The set of the print medium represents, for example, a unit of plural sheets of the print medium which is cut one time. Thus, in the case of cutting each print medium constituting the set, after the uppermost print medium is located at the top of the stacked print media, the plural sheets of the print medium are cut on the basis of the reference mark printed on the uppermost print medium.

The printing control unit may form an empty area having no ink droplets between an image formed by the preliminary printing and the reference mark. According to the configuration, the empty area is formed on the print medium between a print image through the preliminary printing and the reference mark. Thus, in the case in which the reference mark is optically read by using a machine or checked visually by a user in a cutting process, the reference mark can be easily distinguished. Further, the printing control unit may allow the ink head to eject the ink droplets such that a predetermined density difference occurs between an image formed by the preliminary printing and the reference mark. According to the configuration, the density difference occurs between the image formed by the preliminary printing and the reference mark. Thus, in the case in which the reference mark is optically read by using a machine or checked visually by a user in a cutting process, the reference mark can be easily distinguished.

The technical scope of the invention is not limited to the printing apparatus. For example, the invention can be realized through a printing method including processes corresponding to the elements of the printing apparatus, and a print processing program that prompts a computer to execute functions corresponding to the elements of the printing apparatus. Further, the printing apparatus may be a single type of apparatus or may be constructed by plural devices such as a printer provided with a transport unit and a print head, and a computer that controls the printer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings.

Figure 1:
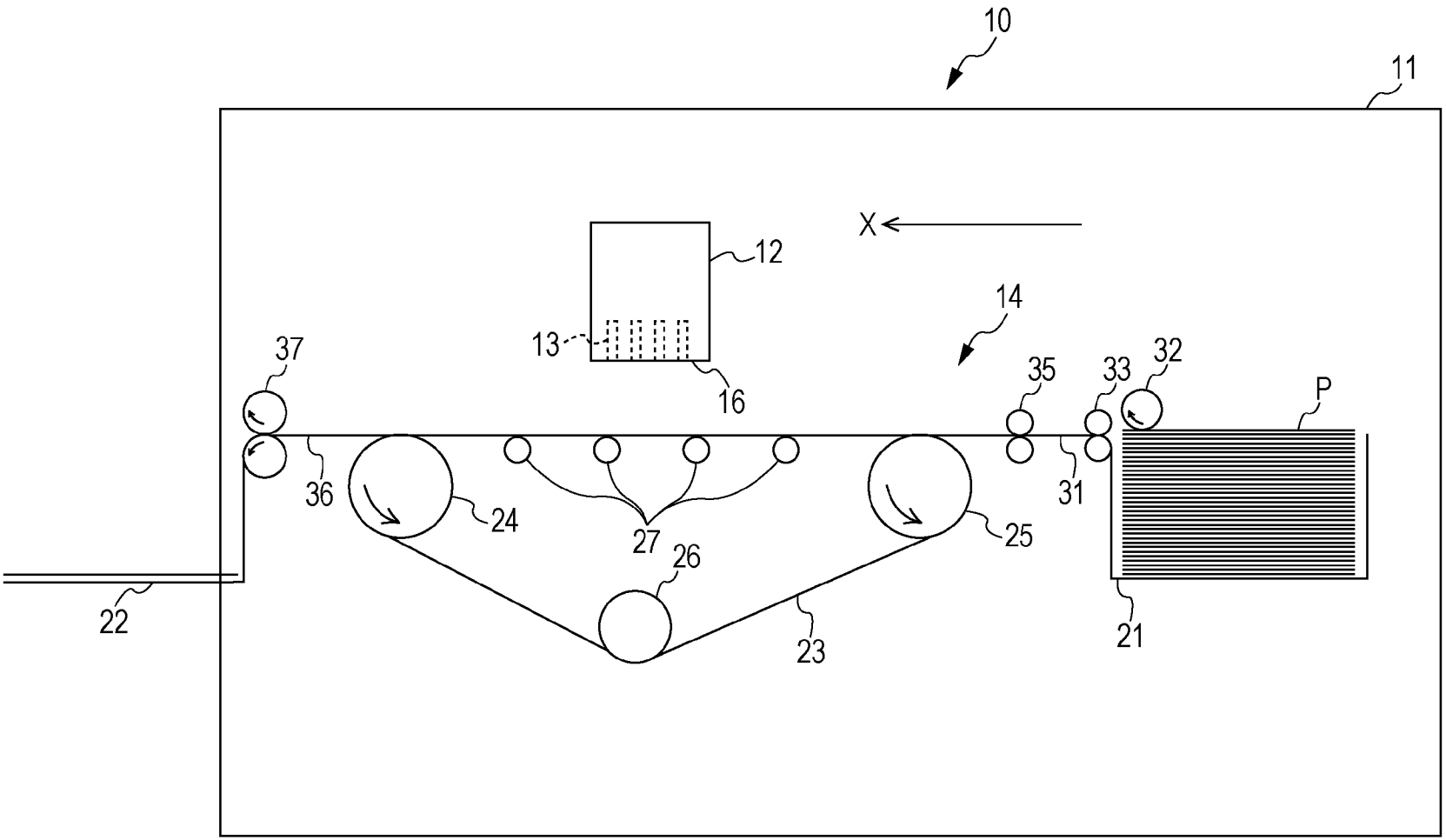
FIG. 1 is a view schematically showing a printer according to an embodiment.

FIG. 1 is a view schematically showing a part of a configuration of an ink jet printer 10 (hereinafter, referred to as a printer 10) according to an embodiment of the invention. The printer 10 corresponds to one example of the printing apparatus of the invention. The printer 10 includes a casing 11, and a print head 12 received in the casing 11 to eject ink (liquid) droplets onto sheets (print medium) P. The print head 12 is provided on a lower surface (nozzle installation surface 16) thereof with a plurality of nozzles 13 that eject the ink droplets. In detail, the nozzles 13 are arranged over the overall width of a print area of the sheets Pin the direction (i.e., direction perpendicular to the surface of the sheet in FIG. 1) crossing the transport direction (i.e., X direction indicated by the arrow in FIG. 1) of the sheets P. According to the embodiment, the printer 10 is known as full line head type printer.

A plurality of ink cartridges (not shown) that store inks having different colors are connected to the print head 12 so that the inks stored in the ink cartridges are occasionally supplied to the print head 12 at a predetermined pressure. In the casing 11, a transport mechanism 14 is installed below the print head 12 to transport the sheets P in the transport direction. The transport mechanism 14 corresponds to one example of a transport unit of the invention.

A paper feeding tray 21 is installed at an upstream side of the transport direction (i.e., the rear side of the transport direction) to receive the stacked sheets P, and a paper discharge tray 22 is installed at a downstream side of the transport direction (i.e., the front side of the transport direction) to receive the sheets P after printing. The transport mechanism 14 includes a transport belt 23 for transporting the sheets P by allowing the sheets P to pass through a position (i.e., ink ejection position facing the nozzle installation surface 16) below the nozzle installation surface 16. The transport belt 23 is wound around a driving roller 24 driven after printing starts, a driven roller 25 that rotates together with the driving roller 24 in a state in which the driven roller 25 is level with the driving roller 24, and a tension roller 26 located below an intermediate position between the driving roller 24 and the driven roller 25 in a state in which tension is applied to the transport belt 23. The driving roller 24, the driven roller 25 and the tension roller 26 are disposed so that the transport belt 23 forms a triangular shape when the transport belt 23 is tensely installed on the three rollers 24, 25 and 26.

A plurality of auxiliary transport rollers 27 (four in the embodiment) are disposed between the driving roller 24 and the driven roller 25. The transport belt 23 is horizontally supported by the auxiliary transport rollers 27 in the upward direction. A first guide plate 31 is provided between the paper feeding tray 21 and the transport belt 23 to guide the sheets P toward the driven roller 25. A pick up roller 32 is provided at an upper portion of the paper feeding tray 21 to pick up the sheet P located at the uppermost portion of the paper feeding tray 21. A pair of paper feeding rollers 33 is provided at the connection portion between the paper feeding tray 21 and the first guide plate 31 to transport only one of the sheets P which are picked up in a state in which the sheets P overlap each other through friction. A pair of paper gate rollers 35 is provided at a predetermined position of the first guide plate 31 and is driven when the sheets P are transported toward a downstream side of the driven roller 25 via the first guide plate 31.

A second guide plate 36 is provided between the transport belt 23 and the paper discharge tray 22 to guide the sheets P from the driving roller 24 to the paper discharge tray 22. A pair of paper discharge rollers 37 is provided between the second guide plate 36 and the paper discharge tray 22 to discharge the sheets P after printing to the paper discharge tray 22. As disclosed in JP-A-2007-112097, the printer 10 may further include a base sheet transport mechanism to transport a base sheet for receiving ink leaked from the sheets P when borderless printing is performed, and the sheets P may be transported through the transport belt 23 in a state in which the sheet P overlaps the base sheet.

Figure 2:
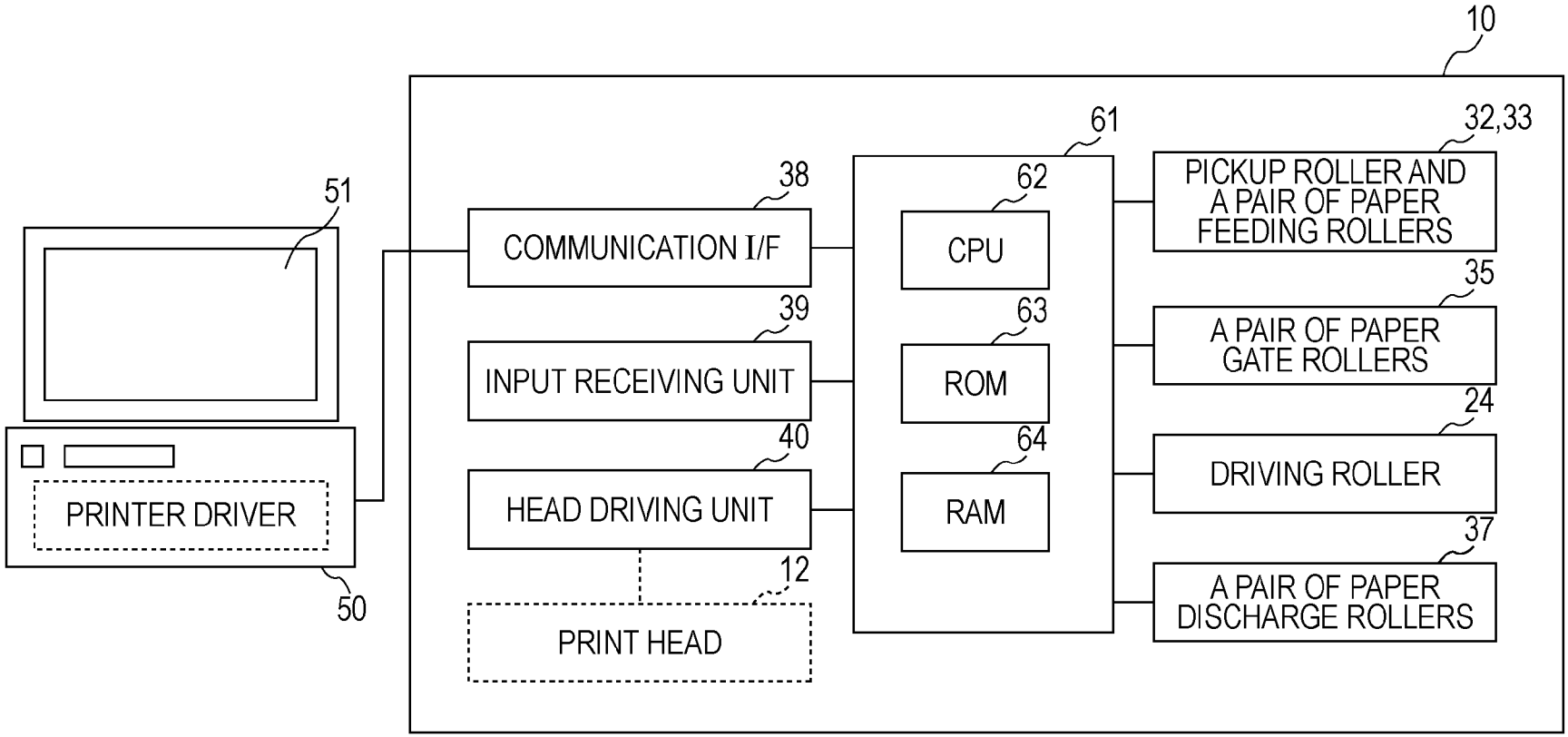
FIG. 2 is a block diagram showing an electrical configuration of a printer.

FIG. 2 is a block diagram schematically showing an electrical configuration of the printer 10 and the like. The printer 10 includes a controller 61 having at least a CPU 62, a ROM 63 and a RAM 64. The controller 61 controls operations of the print head 12 and the transport mechanism 14 by allowing the CPU 62 to execute a predetermined control program stored in the ROM 63 using the RAM 64 as a working area. The controller 61 is electrically connected to a communication interface (IF) 38, an input receiving unit 39, the rollers (the pick up roller 32, the paper feeding rollers 33, the paper gate rollers 35, the driving roller 24 and the paper discharge rollers 37) constituting the transport mechanism 14, a head driving unit 40 and the like.

The communication IF 38 is connected to an external apparatus (a personal computer (PC) 50 in the example of FIG. 2) to receive print data (e.g., raster data for each ink which represents an image to be printed) from the external apparatus. The input receiving unit 39 can receive instructions input from users through a button (not shown) or a user interface such as a touch panel (not shown) provided in the printer 10, and transmit the instructions to the controller 61. The head driving unit 40 generates a voltage pattern (a driving signal) for driving the nozzles 13 (in detail, piezoelectric elements provided in the nozzles 13) of the print head 12, which corresponds to the raster data, under the control of the controller 61, and ejects ink droplets from the nozzles 13 by driving the nozzles 13 in response to the driving signal. Further, the controller 61 transports the sheets P by controlling driving (rotation) of the predetermined rollers constituting the transport mechanism 14 based on detection signals from various sensors (not shown) that correctly detect the front end position of the sheets P on a transport path of the sheets P.

Figure 3:
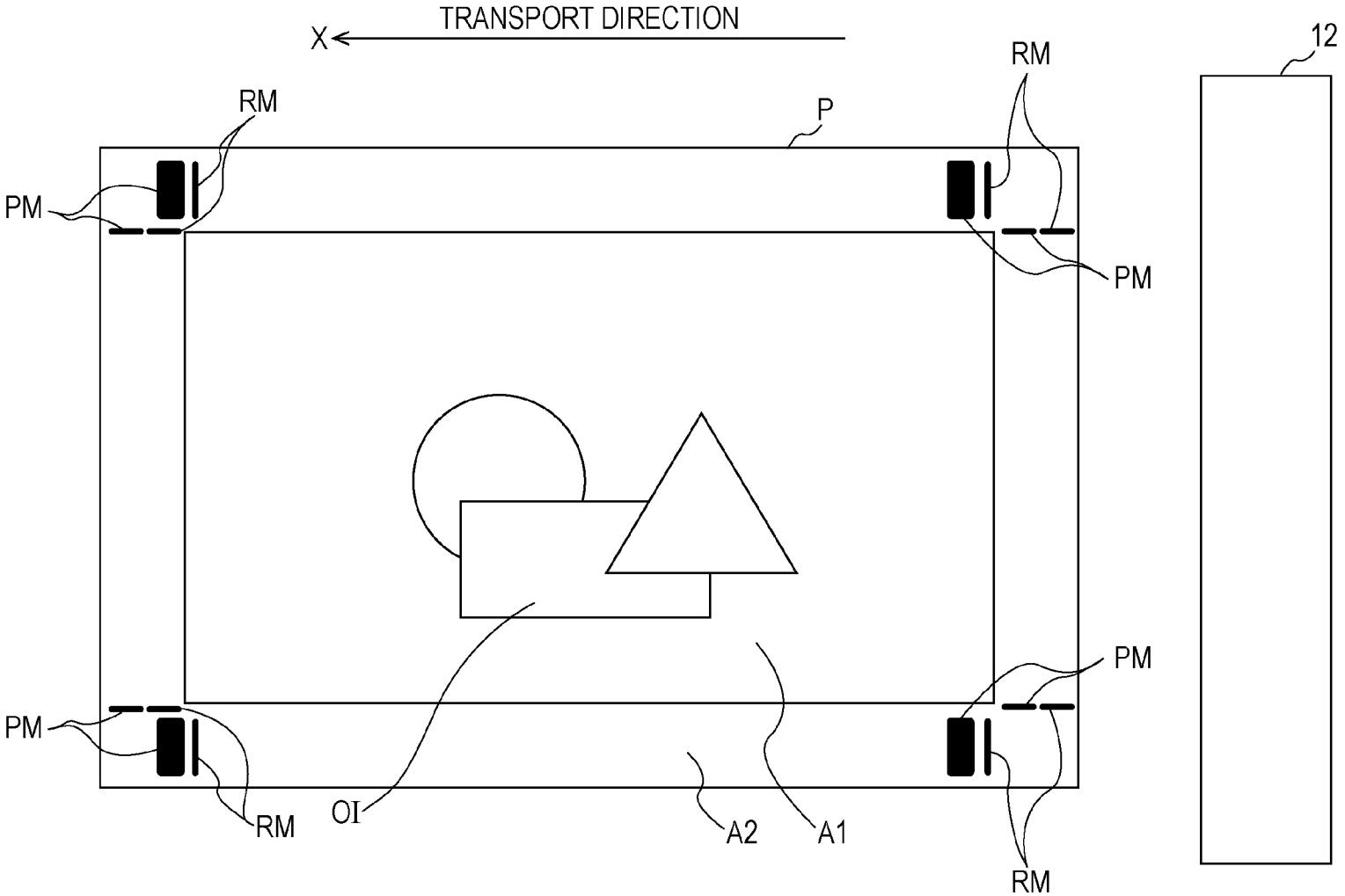
FIG. 3 is a view showing one example of a print result with respect to a sheet.

FIG. 3 is a view showing an example in which an image (hereinafter, referred to as an object image) desired by users is printed onto the sheets P by the printer 10. In the example of FIG. 3, the object image OI is printed within a rectangular area A1 of the substantially center portion of the sheet P, and preliminary marks PM and reference marks RM are printed on a peripheral area A2 of the rectangular area A1. The reference marks RM indicate positions (specific positions) for cutting the peripheral area A2 from the sheet P, and specify positions of the horizontal and vertical sides of the rectangular area A1 at the four corners of the sheet P. In the example of FIG. 3, the reference marks RM are expressed by lines (horizontal cut lines) parallel to the transport direction and lines (vertical cut lines) perpendicular to the transport direction. Further, each of the preliminary marks PM corresponds to an image (formed through preliminary printing) previously printed in the peripheral area A2 as compared with a corresponding reference mark RM, and is located at a downstream side of the transport direction as compared with a corresponding reference mark RM.

According to the embodiment, when a user gives instructions for the printing of the object image OI and the reference marks RM through a predetermined application screen (a user interface screen) displayed on a monitor 51 (see FIG. 2) of the PC 50, the preliminary marks PM and the reference marks RM are printed onto the sheet P together with the object image OI as described above. In detail, if the instructions for the printing of the object image OI and the reference marks RM are received through the application screen, the PC 50 executes a predetermined printer driver corresponding to the printer 10. Further, the PC 50 performs image processing corresponding to the printer driver, that is, performs color conversion with respect to image data (e.g., image data obtained by expressing each pixel using a RGB gray scale), which represents the object image OI, according to a color specification system for ink colors used by the printer 10. Next, the PC 50 synthesizes the color-converted data with data (hereinafter, referred to as additional data) stored in the PC 50 in advance, which is obtained by expressing the preliminary marks PM and the reference marks RM by using gray scale values of ink colors (e.g., black (K) ink) for each pixel according to a predetermined position relationship. Then, the PC 50 generates raster data by performing halftone processing or rasterization processing with respect to the synthesized data, and transmits the generated raster data (print data) to the printer 10.

In the image processing by the printer driver, the additional data representing the preliminary marks PM and the reference marks RM is not synthesized with respect to all pages of the object image OI to be printed. That is, the synthesis is performed with respect to only data corresponding to the uppermost page in the set of sheets P which are to be collected and cut through a cutting process after printing. The uppermost page in the cutting process, for example, corresponds to the first page of a publication when the object image OI is printed on a plurality of pages of the publication. The printer driver performs the synthesis process with respect to only data corresponding to the first page. In such a case, the sheets P after printing, which constitute one publication, become the set of sheets P which are collected and cut.

In a case in which the number (the number of cutting pages) of sheets P which are collected and cut has been previously set, that is, the number of cutting pages is stored in the PC 50 and the like as information, the printer driver may perform the synthesis process with respect to only data of the first page for every number (e.g., 100 pages) of cutting pages in the process of performing the image processing in order to perform printing relative to a plurality of sheets P. In such a case, when sheets P, which correspond to the number of cutting pages, are subject to a printing process several times, the sheets P become the set of sheets P which are collected and cut.

After the raster data generated as described above is received in the printer 10, the controller 61 controls the driving of the predetermined rollers constituting the transport mechanism 14, together with the head driving unit 40 based on the raster data. As a result, as shown in FIG. 3, not only the object image OI but also the preliminary marks PM and the reference marks RM are printed on only the uppermost sheet P in the cutting process from among the set of plural sheets P which are cut one time. Further, only the object image OI is printed on remaining sheets P except for the uppermost sheet P in the cutting process from among the set. The controller 61 corresponds to one example of a printing control unit. Further, when a resultant obtained by integrating the printer 10 with the PC 50 is regarded as the printing apparatus of the invention, the printer driver and the controller 61 correspond to one example of the printing control unit.

Figure 4:
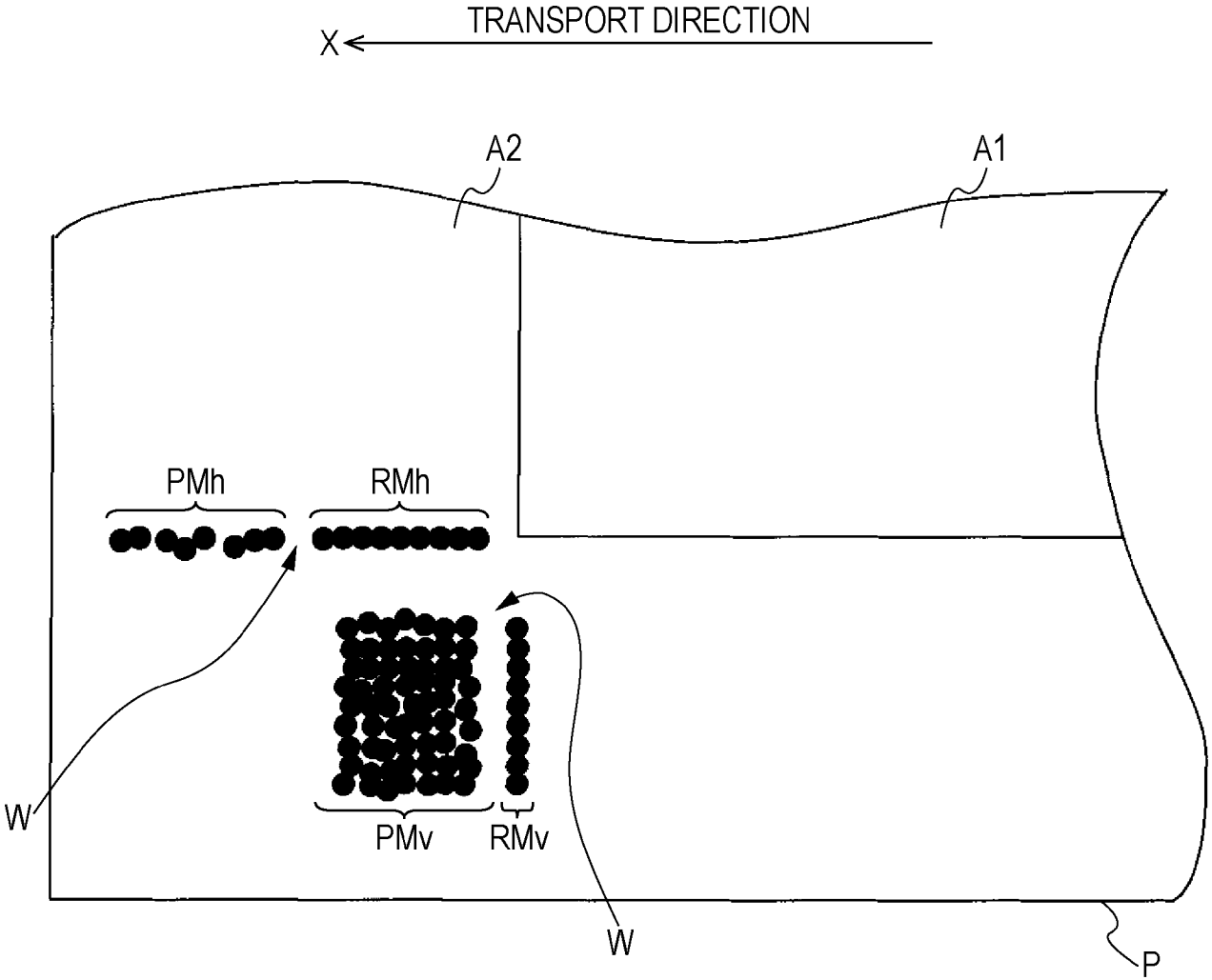
FIG. 4 is a view showing a part of a print result.

FIG. 4 is a view showing a part of the print result shown in FIG. 3. As shown in FIG. 4, preliminary marks PMh corresponding to the horizontal cut lines RMh are printed at a downstream side of the transport direction on the sheet P as compared with a horizontal cut line RMh serving as reference marks RM. That is, the printer 10 prints the preliminary marks PMh through the nozzles 13 (the nozzles 13 corresponding to a print position of the horizontal cut line RMh on the sheet P), which are used for printing the horizontal cut line RMh, before the horizontal cut lines RMh are printed. Further, preliminary marks PMv corresponding to a vertical cut line RMv are printed at a downstream side of the transport direction as compared with the vertical cut line RMv serving as reference marks RM. That is, the printer 10 prints the preliminary marks PMv through the nozzles 13 (the nozzles 13 corresponding to a print position of the vertical cut line RMv on the sheet P), which are used for printing the vertical cut line RMv, before the vertical cut line RMv is printed.

As described above, the printer 10 prints the preliminary marks PM and the reference marks RM, which correspond to each other, through the same nozzles 13, so that the preliminary marks PM and the reference marks RM are basically printed with the same color. As shown in FIGS. 3 and 4, the printer 10 forms an empty area W between the preliminary marks PM and the reference marks RM, which correspond to each other, by blocking the ejection of ink droplets. That is, an area with a background color of the sheet P is provided between the preliminary marks PM and the reference marks RM, which correspond to each other. As described above, the empty area W is formed, so that the reference marks RM can be easily distinguished from the preliminary marks PM. Thus, in a case in which the reference marks RM are optically read by using a machine or checked visually by a user when the sheets P are cut, the reference marks RM can be easily distinguished.

Instead of forming the empty area W between the preliminary marks PM and the reference marks RM, the printer 10 may print the preliminary marks PM and the reference marks RM by ejecting ink droplets from the nozzles 13 such that a predetermined density difference occurs between the preliminary marks PM and the reference marks RM. For example, the printer 10 may print the reference marks RM with higher density as compared with the preliminary marks PM. As described above, the density difference occurs between the preliminary marks PM and the reference marks RM, so that the reference marks RM can be easily distinguished from the preliminary marks PM. Thus, in a case in which the reference marks RM are optically read by using a machine or checked visually by a user when the sheets P are cut, the reference marks RM can be easily distinguished.

As described above, in the ink jet printer as described above, if nozzles are not used for a predetermined period of time, ink viscosity is increased in the vicinity of an opening of the nozzle, so ejection failures may occur. Thus, when the reference marks RM are printed on the sheet P through the printer 10, if ink droplets are suddenly ejected from the nozzle 13 for the printing of the reference marks RM, the ink droplets may not ejected due to the ejection failures, or the ejected ink droplets may not be exactly dropped at predetermined landing positions on the sheet P.

Figure 5:
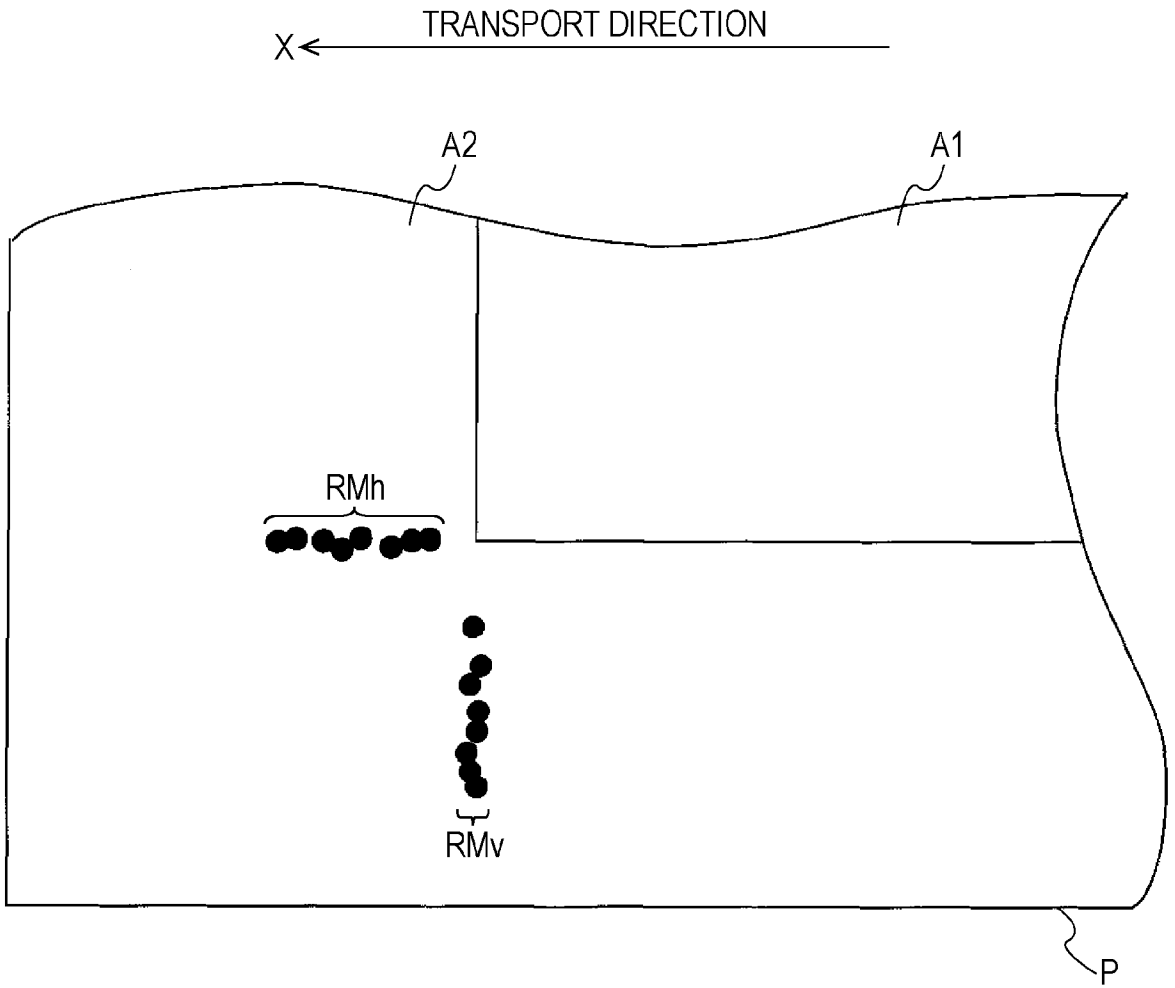
FIG. 5 is a view showing a print result according to an embodiment as compared with the related art.

FIG. 5 is a view showing a print result according to an embodiment as compared with FIG. 4, which shows a part of the sheet P when the printer 10 has printed only the reference marks RM on the peripheral area A2 after receiving the instructions for the printing of the object image OI and the reference marks RM from a user. In the example of FIG. 5, the preliminary marks PM are not printed, but the reference marks RM (horizontal cut line RMh and vertical cut line RMv) are printed. That is, the nozzle 13 which may cause ejection failure is driven to record, so ink droplets constituting the reference marks RM on the sheet P may not be exactly dropped at predetermined landing positions (the predetermined landing positions may not be aligned in a row), or a part of the reference marks RM may not be recorded due to the lack of ink droplets as shown in FIG. 5.

However, according to the embodiment, when printing the reference marks RM on the sheet P as described above, the preliminary marks PM are recorded at the front side of the transport direction as compared with the print position of the reference marks RM through preliminary printing in which ink droplets are ejected from the nozzle 13 the same as the nozzle 13 used for printing the reference marks RM. Through the preliminary printing, the ink droplets are ejected from the nozzle 13 several times, so that ink with high viscosity collected in the vicinity of the opening of the nozzle 13 is ejected, thereby preventing ejection failure of the nozzle 13 (As shown in FIG. 4, the preliminary marks PM correspond to an image formed when ink droplets are not dropped or are not exactly dropped at the predetermined landing positions). As a result, when the reference marks RM are printed through the nozzle 13 used for printing the preliminary marks PM, the ejection state (ejection speed, ejection angle and the like) of ink droplets is in a normal state. Thus, as shown in FIG. 4, the reference marks RM (the horizontal cut line RMh and the vertical cut line RMv) become straight lines. That is, according to the embodiment, ejection failure of the nozzle 13 can be prevented from occurring, so that the reference marks RM representing the cutting position of the sheets P can be exactly printed. Thus, in the case of cutting the sheets P after the object image OI is printed, the sheets P can be exactly cut from the cutting position.

In particular, according to the embodiment, the reference marks RM are printed with respect to only the uppermost sheet P from among the set of sheets P which are to be collected and cut, so that the time interval may be slightly increased between the time for which the reference marks RM are printed on one sheet P and the time for which the reference marks RM are printed on another sheet P. Thus, the ejection failure as described above may easily occur in the nozzle 13 used for printing the reference marks RM. However, the preliminary marks PM are printed according to the embodiment, so that the ejection failure state of the nozzle 13 is solved when the reference marks RM are printed.

Further, the printer 10 prints the reference marks RM (and the preliminary marks PM) with respect to only the uppermost sheet P, the amount of ink consumed can be significantly reduced as compared with the related art in which reference marks are printed on all sheets P.

Further, when the embodiment is realized, the printer 10 (the input receiving unit 39, the controller 61 and the like) can partially or completely perform the processing (reception of the print instructions through the user interface screen and processing by the printer driver) by the PC 50. For example, after the PC 50 receives the print instructions for the object image OI and the reference marks RM, the PC 50 can transmit print data representing the object image OI and a command giving instruction for the printing of the reference marks RM to the printer 10. Further, after the printer 10 receives the print data and the command, the printer 10 can print an image obtained by synthesizing the object image OI represented by the print data with an image of the preliminary marks PM and the reference marks RM. In such a case, the printer 10 prints the preliminary marks PM and the reference marks RM with respect to only the uppermost sheet P from among the set of sheets P which are to be collected and cut.

What is claimed is:

1. A printing apparatus for printing on a print medium, the print medium comprising an object image area for an image to be printed thereon, and a peripheral area to be removed from the print medium by cutting, the apparatus comprising:

a transport unit that transports the print medium in a predetermined transport direction; and a printing control unit that performs predetermined preliminary printing by ejecting ink droplets through a plurality of nozzles, which are the same as nozzles used for printing a reference mark for cutting the print medium, onto an area on a downstream side of a specific position, where the area and the specific position are in the peripheral area, in the transport direction in an area of the print medium before printing the reference mark on the specific position of the print medium by ejecting ink droplets through a print head provided with the nozzles for ejecting the ink droplets.

2. The printing apparatus according to claim 1, wherein, in the case of performing printing the same image in the object image area with respect to each print medium constituting a set of stacked plural sheets of print medium by driving the print head based on predetermined print data, the printing control unit performs printing of the reference mark and the preliminary printing onto only an uppermost print medium of the set for cutting.

3. The printing apparatus according to claim 1, wherein the printing control unit forms an empty area having no ink droplets between an image formed by ejecting a droplet from one of the nozzles by the preliminary printing and the reference mark formed by ejecting an additional droplet from the same nozzle after the preliminary printing.

4. The printing apparatus according to claim 1, wherein the printing control unit allows the ink head to eject the ink droplets such that a predetermined density difference occurs between an image formed by ejecting a droplet from one of the nozzles by the preliminary printing and the reference mark formed by ejecting an additional droplet from the same nozzle after the preliminary printing.

5. A printing method for printing on a print medium, the print medium comprising an object image area for an image to be printed thereon, and a peripheral area to be removed from the print medium by cutting, the method comprising:

transporting the print medium in a predetermined transport direction; and performing predetermined preliminary printing by ejecting ink droplets through a plurality of nozzles, which are the same as nozzles used for printing a reference mark for cutting the print medium, onto an area on a downstream side of a specific position, wherein the area and the specific position are in the peripheral area, in the transport direction in an area of the print medium before printing the reference mark on the specific position of the print medium by ejecting ink droplets through a print head provided with the nozzles for ejecting the ink droplets.

6. The printing method according to claim 5, wherein, in the case of performing printing the same image in the object image area with respect to each print medium constituting a set of stacked plural sheets of print medium by driving the print head based on predetermined print data, the method performs printing of the reference mark and the preliminary printing onto only an uppermost print medium of the set for cutting.

7. The printing method according to claim 5, further comprising forming an empty area having no ink droplets between an image formed by ejecting a droplet from one of the nozzles by the preliminary printing and the reference mark formed by ejecting an additional droplet from the same nozzle after the preliminary printing.

8. The printing method according to claim 5, further comprising allowing the ink head to eject the ink droplets such that a predetermined density difference occurs between an image formed by ejecting a droplet from one of the nozzles by the preliminary printing and the reference mark formed by ejecting an additional droplet from the same nozzle after the preliminary printing.

9. A printing apparatus for printing on a print medium, the print medium comprising an object image area for an image to be printed thereon, and a peripheral area to be removed from the print medium, the apparatus comprising:

a transport unit that transports the print medium in a predetermined transport direction; and a printing control unit that:

performs preliminary printing in the peripheral area by ejecting ink droplets through a plurality of nozzles onto an area of the peripheral area downstream of a specific position of the peripheral area in the transport direction; and prints a reference mark on the specific position by ejecting ink droplets through the nozzles; wherein the specific position of the reference mark indicates a border between the object image area and the peripheral area.

10. The printing apparatus according to claim 9, wherein the print medium comprises a plurality of stacked print media, and the printing control unit performs printing of the reference mark and the preliminary printing onto only an uppermost one of the print media.

11. The printing apparatus according to claim 9, wherein the printing control unit forms an empty area having no ink droplets between an image formed by the preliminary printing and the reference mark.

12. The printing apparatus according to claim 9, wherein the printing control unit allows the nozzles to eject the ink droplets such that a predetermined density difference occurs between an image formed by the preliminary printing and the reference mark.

13. A printing method for printing on a print medium, the print medium comprising an object image area for an image to be printed thereon, and a peripheral area to be removed from the print medium, the method comprising:

transporting a print medium in a predetermined transport direction;

performing preliminary printing in the peripheral area by ejecting ink droplets through a plurality of nozzles onto an area of the peripheral area downstream of a specific position of the peripheral area in the transport direction; and printing a reference mark on the specific position by ejecting ink droplets through the nozzles;

wherein the specific position of the reference mark indicates a border between the object image area and the peripheral area.

14. The printing method according to claim 13, wherein the print medium comprises a plurality of stacked print media, wherein the printing of the reference mark and the preliminary printing comprise printing onto only an uppermost one of the print media.

15. The printing method according to claim 13, further comprising forming an empty area having no ink droplets between an image formed by the preliminary printing and the reference mark.

16. The printing method according to claim 13, further comprising allowing the nozzles to eject the ink droplets such that a predetermined density difference occurs between an image formed by the preliminary printing and the reference mark.

* * * * *